US006167917B1

(12) United States Patent
Scott Aitken

(10) Patent No.: US 6,167,917 B1
(45) Date of Patent: Jan. 2, 2001

(54) DRILL PIPE

(75) Inventor: William Russell Scott Aitken, Kincardineshire (GB)

(73) Assignee: Schoeller Bleckmann Oilfield Equipment Limited (GB)

( * ) Notice: Under 35 U.S.C. 154(b), the term of this patent shall be extended for 0 days.

(21) Appl. No.: 09/242,573

(22) PCT Filed: Aug. 20, 1997

(86) PCT No.: PCT/GB97/02236

§ 371 Date: Apr. 22, 1999

§ 102(e) Date: Apr. 22, 1999

(87) PCT Pub. No.: WO98/09046

PCT Pub. Date: Mar. 5, 1998

(30) Foreign Application Priority Data

Aug. 27, 1996 (GB) ..... 9617819

(51) Int. Cl.[7] ..... E16L 9/02; E21B 10/26

(52) U.S. Cl. ..... 138/177; 138/178; 138/DIG. 11; 175/377; 175/406

(58) Field of Search ..... 138/177, 178, 138/DIG. 11; 175/332, 335, 336, 345, 377, 406

(56) References Cited

U.S. PATENT DOCUMENTS

| | | | | |
|---|---|---|---|---|
| 2,217,592 | * | 10/1940 | Krick et al. | 175/377 |
| 2,589,534 | * | 3/1952 | Buttolph | 175/406 |
| 2,676,820 | * | 4/1954 | Boice | 138/177 |
| 4,146,060 | * | 3/1979 | Garrett | 138/143 |
| 4,549,613 | * | 10/1985 | Case | 175/406 |
| 4,760,889 | * | 8/1988 | Dudman | 138/177 |
| 5,074,356 | * | 12/1991 | Neff | 175/406 |
| 5,181,564 | * | 1/1993 | Lindley et al. | 175/406 |

FOREIGN PATENT DOCUMENTS

| | | |
|---|---|---|
| 138603 | 4/1985 | (EP) . |
| 313413 | 4/1989 | (EP) . |
| 2 517 357 | 3/1983 | (FR) . |
| 94/27024 | 11/1994 | (WO) . |

* cited by examiner

*Primary Examiner*—James Hook
(74) *Attorney, Agent, or Firm*—Ratner & Prestia

(57) ABSTRACT

A drill pipe having a length of conduit having a first diameter, a first and a second end portion, where each end portion has a second diameter greater than the first diameter. An enlarged portion is located between and spaced from the first and second end portions, where the enlarged portion comprises a central section which has a third diameter greater than the first diameter. The central section has a substantially smooth external surface, and two end sections, one end section at either end of the central section, which vary in diameter between the first and the third diameter. One of the end sections has a spiral formation thereon.

14 Claims, 2 Drawing Sheets

DRILL PIPE

The invention relates to drill pipe and, in particular, drill pipe for use in drilling boreholes, such as oil and/or gas wells.

Modern drilling techniques in the exploration of oil and gas permit the drilling of boreholes which have a large angle of deviation from the vertical, and in some cases boreholes may be horizontal or close to the horizontal. Such boreholes are known as lateral wells. However, during drilling of a lateral well, the drill cuttings tend to accumulate on the lower side of the hole and it is difficult to flush the drill cuttings out of a lateral well with the normal drilling fluid flow between the drill string and the inside surface of the borehole.

Accordingly, in recent years proposals have been made for enhancing the agitation of the drill cuttings within lateral wells to help prevent accumulation of the drill cuttings on the lower side of the borehole.

Some of these proposals include forming upsets on the drill pipe and putting spiral formations on the surface of the upsets to agitate the drill cuttings in the lower section of the well as the drill pipe is rotated. However, this type of drill pipe has the disadvantage that it can tend to cut into the side wall of the bore hole as it rotates.

In accordance with present invention, a drill pipe comprises a length of conduit having a first diameter, a first and a second end portion, each end portion having a second diameter greater than the first diameter, and an enlarged portion located between and spaced from the first and second end portions, the enlarged portion comprising a central section having a third diameter greater than the first diameter and the central section having a substantially smooth external surface, and two end sections, one end section at either end of the central section, which vary in diameter between the first and the third diameter, and one of the end sections having a spiral formation thereon.

Preferably, the spiral formation is located between the central section and the upper end of the drill pipe.

Preferably, the external surface of the central section is a substantially cylindrical surface.

Typically, three of said enlarged portions may be provided on the drill pipe.

Preferably, the other end section may comprise a curved surface which may be convex and is typically radiused.

Alternatively, the other end section may typically comprise a linearly sloping surface.

Preferably, the spiral formations are deeper and/or wider adjacent the central section.

Preferably, the end section in which the spiral formations are formed has a concave shape.

Alternatively, the end section in which the spiral formations are formed may comprise a curved surface which may be convex and is typically radiused.

Examples of a drill pipe in accordance with the invention will now be described with reference to the accompanying drawings, in which.

Figure 1:
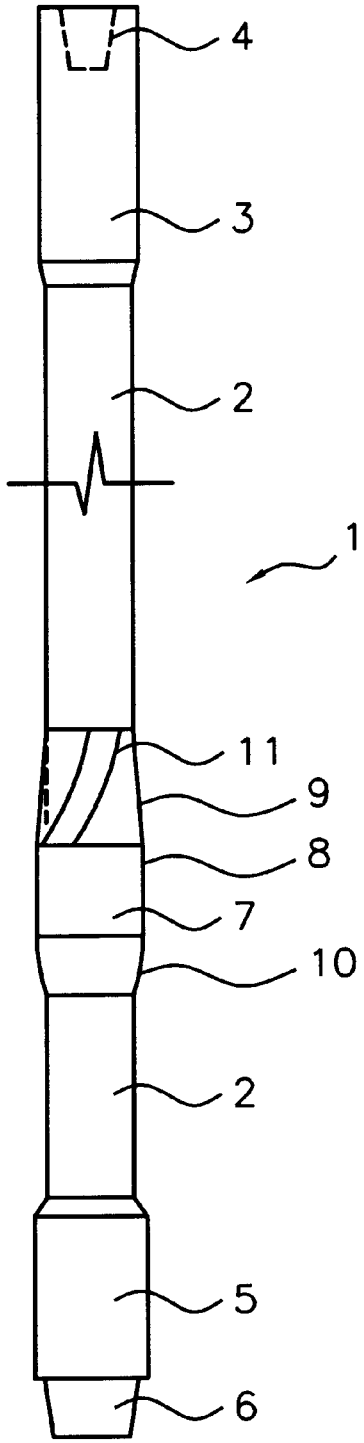
FIG. 1 is a side view of a length of drill pipe.

FIG. 1 shows a side view of a length of a drill pipe 1 which comprises a tube section 2 which has a first diameter and a first enlarged end portion 3 having a second diameter at the upper end which includes a threaded box connection 4, and a second enlarged end portion 5 which is the same diameter as the portion 3 at the lower end which has a threaded pin connection 6. The threaded box connection 4 and threaded pin connection 6 permit the drill pipe 1 to be connected to other lengths of drill pipe (not shown) to form a drill string for drilling a borehole, such as an oil/or gas well.

The tube 2 also has an enlarged central portion 7 with a central cylindrical surface 8 which is parallel to the exterior walls of the tube 2 and the longitudinal axis of the drill pipe 1. The cylindrical surface 8 is smooth and is connected to the tube 2 at its upper end by a concave surface 9 and to the lower portion of tube 2 by a convex surface 10. Located in the concave surface 9 are a number of spiral formations 11 which are cut out of the concave surface 9.

The drill pipe 1 shown in FIG. 1 is truncated and the full length of drill pipe 1 would typically have three enlarged central portions 7 spaced along its length between the enlarged end portions 3, 5. Preferably, two of the enlarged central portions 7 have a spiral formation 11 formed in one direction around the circumference of the concave surface 9, and the third enlarged central portion 7 having a spiral formation 11 formed in the other direction.

In addition, hard banding may be applied to the enlarged portion 7, if desired.

An advantage of the drill pipe 1 is that the cylindrical surface 8 is smooth which helps prevent the enlarged section biting into the side walls of the bore hole during drilling. However, the spiral formations 11 help to promote agitation of drill cuttings within the well to mitigate the problems of drill cuttings collecting on the lower side of the well. Typically, the spiral formations 11 would be deeper and wider adjacent the cylindrical surface 8 than adjacent the tube 2.

In addition, the maximum diameter of the enlarged portion 7 is typically less than or equal to the diameter of the enlarged end portions 3, 5.

Figure 2:
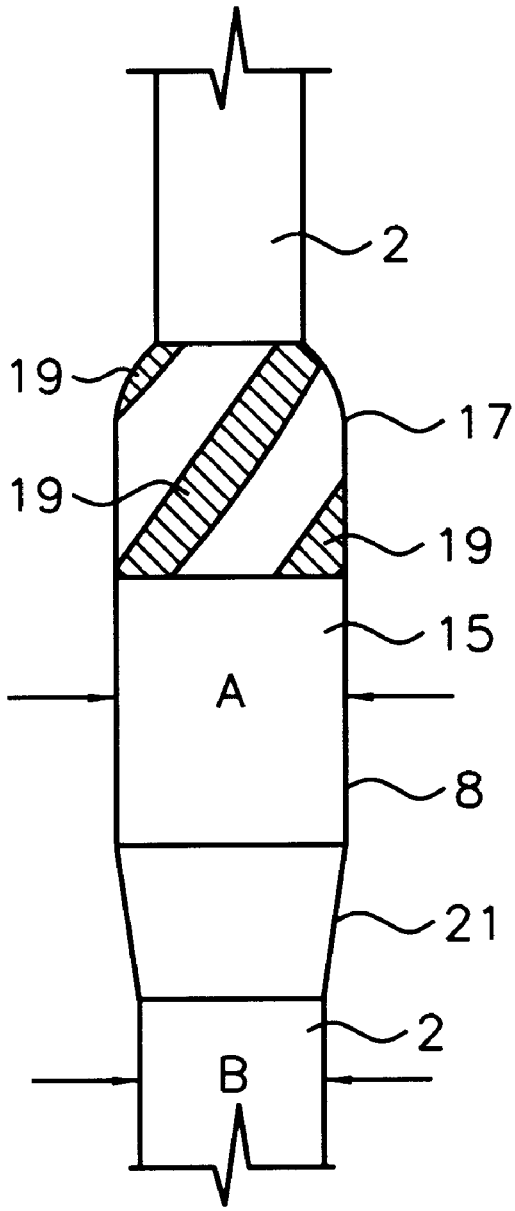
FIG. 2 is a side view of a section of a length of drill pipe.

FIG. 2 shows a second example of an enlarged central portion 15 which can be incorporated into a length of the drill pipe 1 shown in FIG. 1 in addition to, or instead of the enlarged central portion 7 of FIG. 1.

The enlarged central portion 15 of FIG. 2 has a similar central cylindrical surface 8 to that of FIG. 1. However, the central cylindrical surface 8 of FIG. 2 is connected to the tube section 2 at its upper end by a convex and radiussed surface 17, into which are cut six spiral formations 19. The central cylindrical surface 8 is connected at its lower end to the tube 2 by a linearly sloping section 21.

As the upper end has a convex and radiused surface 17, the invention has the advantage that a greater surface area of metal may be scooped away to form the spiral formations 19, which increases the efficiency of the invention by causing greater turbulence, in use.

The longitudinal length of each of the linearly sloping section 21, cylindrical surface 8 and the convex and radiussed section 17 is 9". For a tube whose diameter at section B is 5", the diameter of the cylindrical surface 8 is 6¾", and for a tube whose diameter at section B is 6⅝", the diameter of the cylindrical surface 8 is 8¼".

Modifications and improvements may be incorporated without departing from the scope of the invention.

What is claimed is:

1. A drill pipe comprising a length of conduit having a first diameter, a first and a second end portion, each end portion having a second diameter greater than the first diameter, and an enlarged portion located between and spaced from the first and second end portions, the enlarged portion comprising a central section having a third diameter greater than the first diameter and the central section having a substantially smooth external surface, and two end sections, one end section at either end of the central section, which vary in diameter between the first and the third diameter, and one of the end sections having a spiral formation thereon.

2. A drill pipe according to claim 1, wherein the spiral formation is located between the central section and the first end portion of the drill pipe, where the first end portion is an upper end of the drill pipe, in use.

3. A drill pipe according to either of claims 1 or 2, wherein the external surface of the central section is a substantially cylindrical surface.

4. A drill pipe according to claim 1 wherein three enlarged portions are provided on the drill pipe.

5. A drill pipe according to any of claims 1, 2 or 4, wherein the other end section comprises a linearly sloping surface.

6. A drill pipe according to claim 1 wherein the other end section comprises a curved surface which is convex.

7. A drill pipe according to claim 1, wherein the other end section comprises a curved surface which is radiused.

8. A drill pipe according to claim 1, wherein the spiral formation is deeper and/or wider adjacent the central section.

9. A drill pipe according to claim 1, wherein the end section in which the spiral formation is formed has a concave shape.

10. A drill pipe according to claim 1, wherein the end section in which the spiral formation is formed comprises a curved surface which is convex.

11. A drill pipe according to claim 1, wherein the end section in which the spiral formation is formed comprises a curved surface which is radiused.

12. A drill pipe according to claim 1, wherein the third diameter of the enlarged portion is less than or equal to the second diameter of the end portions.

13. A drill pipe according to claim 1, wherein the drill pipe comprises a plurality of enlarged portions spaced along its length.

14. A drill pipe according to claim 13, wherein one or more of the enlarged portions have a spiral formation formed in one direction around the circumference of the one end section, and one or more of the enlarged portions have a spiral formation formed in the other direction.

* * * * *